US005501279A

United States Patent [19]

Garg et al.

[11] Patent Number: 5,501,279

[45] Date of Patent: Mar. 26, 1996

[54] APPARATUS AND METHOD FOR REMOVING PRODUCTION-INHIBITING LIQUID FROM A WELLBORE

[75] Inventors: Arvind K. Garg, Englewood; Jack McAnear, Littleton, both of Colo.

[73] Assignee: Amoco Corporation, Chicago, Ill.

[21] Appl. No.: 372,161

[22] Filed: Jan. 12, 1995

[51] Int. Cl.[6] ..... E21B 43/00

[52] U.S. Cl. ..... 166/372; 166/168

[58] Field of Search ..... 166/369–373, 166/68, 69, 264, 168, 242, 384, 385

[56] References Cited

U.S. PATENT DOCUMENTS

| | | | |
|---|---|---|---|
| Re. 32,866 | 2/1989 | Cruise | 166/310 |
| 1,326,338 | 12/1919 | Gregory . | |
| 1,483,877 | 2/1924 | Gracey . | |
| 1,739,041 | 12/1929 | Ragland . | |
| 2,171,402 | 8/1939 | Muir | 103/234 |
| 3,873,238 | 3/1975 | Elfarr | 417/54 |
| 3,884,299 | 5/1975 | McCarter et al. | 166/68 |
| 3,991,825 | 11/1976 | Morgan | 166/68 |
| 4,222,440 | 9/1980 | Parker | 166/314 |
| 4,223,724 | 9/1980 | Levoni et al. | 166/68 |
| 4,261,419 | 4/1981 | Probstein et al. | 166/52 |
| 4,682,656 | 7/1987 | Waters | 166/372 |
| 4,708,595 | 11/1987 | Maloney et al. | 166/372 X |
| 4,844,166 | 7/1989 | Going, III et al. | 166/372 X |
| 5,211,242 | 5/1993 | Coleman et al. | 166/372 |

OTHER PUBLICATIONS

Artificial Lift Equipment and Services, an Otis Merla Systems Catalog, by Otis Engineering Corporation, 1992.

Gas–Lift, Book 6 of the Vocational Training Series, Sponsored by the Executive Committee on Training and Development of the American Petroleum Institute, Production Dept, Dallas, Texas, 1994.

*Primary Examiner*—Michael Powell Buiz

*Attorney, Agent, or Firm*—Charles P. Wakefield; Robert E. Sloat

[57] ABSTRACT

An apparatus and method are disclosed for continually and intermittently removing water from a wellbore which penetrates a solid carbonaceous subterranean formation, such as a coalbed, while concurrently removing methane from the formation. The apparatus utilizes a linear access means which facilitates switching the apparatus from a continuous water removal mode of operation to an intermittent water removal mode of operation using wireline retrievable tools.

27 Claims, 3 Drawing Sheets

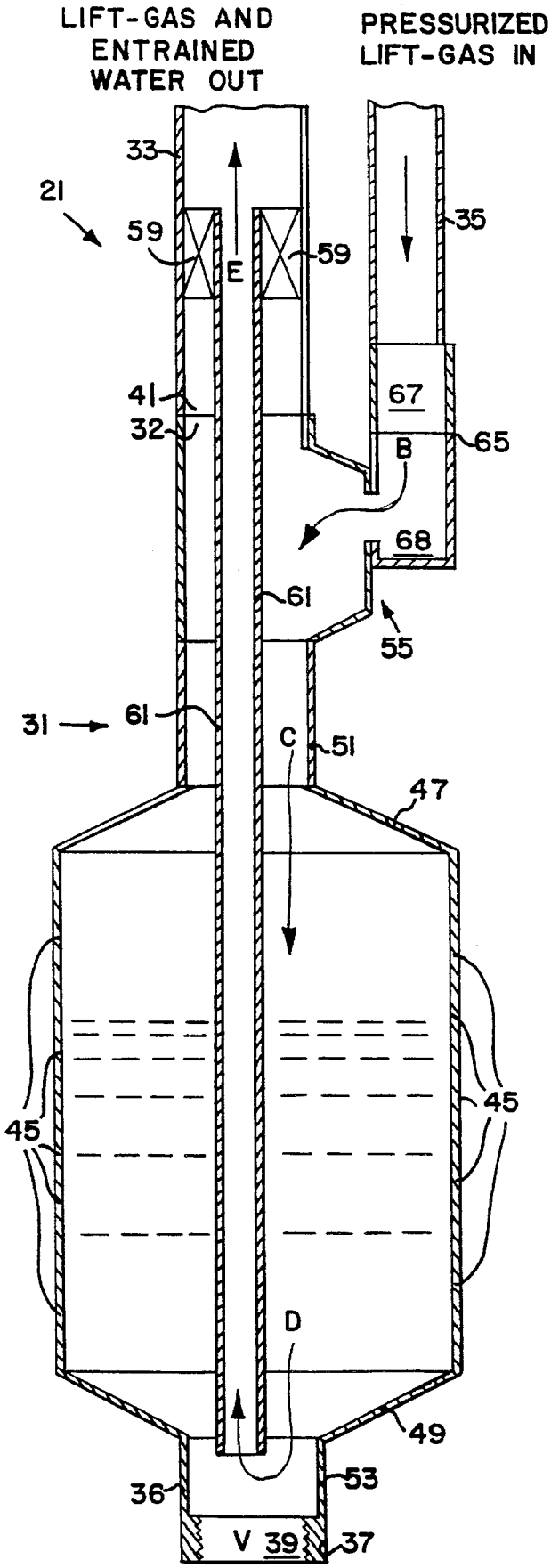
FIG. 2
FIG. 3
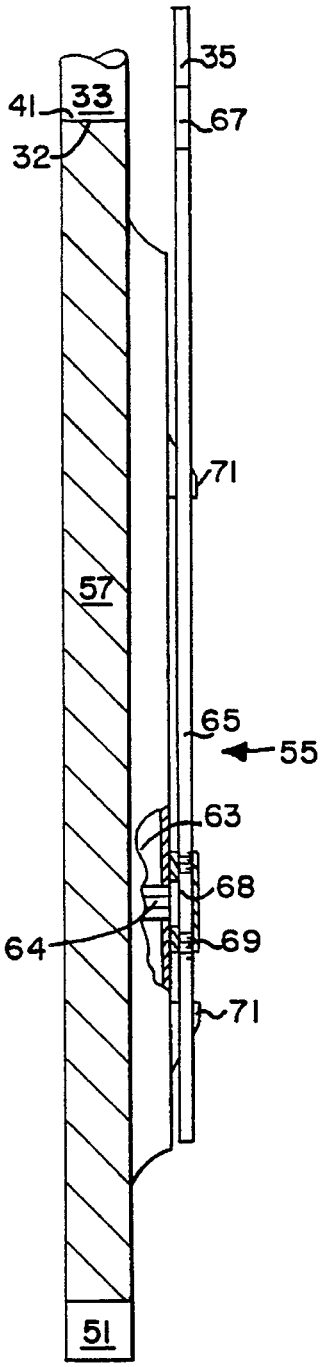

APPARATUS AND METHOD FOR REMOVING PRODUCTION-INHIBITING LIQUID FROM A WELLBORE

FIELD OF THE INVENTION

The invention generally relates to an apparatus and method for removing production-inhibiting liquids from a wellbore. More particularly, the invention relates to an apparatus and method which is capable of continuously or intermittently removing water from a wellbore which penetrates a solid carbonaceous subterranean formation.

BACKGROUND OF THE INVENTION

Solid carbonaceous subterranean formations such as coal seams can contain significant quantities of natural gas. This natural gas is composed primarily of methane. The majority of the methane contained within a solid carbonaceous subterranean formation is adsorbed to the carbonaceous material of the formation. In order to recover the methane from the formation, the pressure within the formation's cleats must be reduced. This will cause methane to desorb from the methane sorption sites and diffuse to the cleats. Once within the cleat system, the methane can flow to a recovery well where it is recovered.

In addition to methane, solid carbonaceous subterranean formations often contain large quantities of water. Typically, to provide a satisfactory methane recovery rate from a recovery wellbore, the region of the formation surrounding the recovery wellbore must be dewatered to lower the pressure within the cleats to a point where sufficient quantities of methane are desorbing from the methane adsorption sites. This dewatering is achieved by reducing a recovery wellbore's pressure to establish a differential pressure between the reservoir pressure of the formation and the wellbore. The differential pressure established will cause the water to flow from the cleats to the recovery wellbore. As the water is removed from the cleat system and the pressure in the cleats is reduced, the methane recovery rate will increase. The recovery of methane from a solid carbonaceous subterranean formation which is controlled by the lowering of the pressure within the cleat system caused by the removal of methane and other fluids from a recovery well is generally referred to as "primary pressure depletion methane recovery."

Once within the wellbore, the water should be removed so that a backpressure is not applied to the formation. A backpressure on the formation can reduce the methane recovery rate from the wellbore or, in some instances, may completely inhibit the flow of methane from the wellbore. This can be a problem especially where the formation is underpressured or undersaturated.

Methane also may be recovered from solid carbonaceous subterranean formations using techniques which take advantage of the reduction in the partial pressure of methane which occurs within the cleats when a gaseous desorbing fluid is injected into the formation. Techniques which enhance the recovery of methane from a solid carbonaceous subterranean formation by the use of an injected gaseous desorbing fluid are hereinafter referred to as "enhanced methane recovery techniques;" such techniques are generally described in U.S. Pat. No. 5,014,785 to Puri et al. As with primary pressure depletion methane recovery, the methane recovery rate may be reduced if water is not removed from a recovery wellbore during enhanced methane recovery.

In general, the water production rate tends to decrease over time as the solid carbonaceous subterranean formation dewaters. However, later in a wellbore's serviceable life, the need to remove water from the wellbore may be greater because the reservoir pressure of the formation typically will be lower, and therefore water in the wellbore can more easily inhibit the flow of methane from the formation.

Small pieces of carbonaceous material, hereinafter referred to as "coalfines," often slough into a wellbore over time. These coalfines can plug up the wellbore and impede the recovery of methane from the wellbore. The coalfines can also plug up equipment which may be used to dewater the wellbore. Therefore, coalfines also must often be removed from a wellbore during the wellbore's serviceable life.

Various lift techniques have been used to remove the water from a wellbore. One technique uses a conventional gas-lift design to lift water out of the wellbore. In a typical gas-lift design, a chamber is formed within the wellbore by setting a wellbore packer above the carbonaceous seam which is located closest to the surface. The chamber's volume is defined by the volume within the wellbore below the packer. A first tubing string set into the packer carries pressurized lift-gas to the chamber. A second tubing string, which passes through the packer to a location near the bottom of the wellbore, transports the water from the wellbore to the surface when pressurized lift-gas is injected into the chamber. One deficiency of such a design is that the pressurization of the chamber by lift-gas places a backpressure on the face of the formation which impedes the flow of methane into the wellbore and thereby reduces the methane recovery rate from the wellbore. Furthermore, many solid carbonaceous subterranean formations comprise several carbonaceous seams which are vertically interspersed with layers of sandstone and other noncarbonaceous materials. These carbonaceous seams may be vertically distributed along the wellbore with the deepest carbonaceous seam located near the bottom of the wellbore and the shallowest carbonaceous seam located near the surface of the earth. In these types of formations, a lift-gas pressure which would be sufficient to remove water from the bottom of the wellbore may completely prevent methane located within the upper carbonaceous seams from flowing into the wellbore.

Another type of gas-lift design uses a prefabricated chamber which is lowered into the wellbore to collect water that flows into the wellbore. An example of such a design is contained in U.S. Pat. No. 5,211,242 to Coleman et al. The apparatus disclosed in Coleman et al. is designed to intermittently remove water from the wellbore to the surface. It comprises a chamber for collecting water from the formation, two individual tubing strings, and a standing valve which is used to isolate the chamber from the surrounding wellbore. One of the tubing strings is used to carry pressurized lift-gas to the chamber; the other tubing string is used to transport water from the chamber to the surface. The standing valve is designed to close when pressurized lift-gas is injected into the chamber, thereby isolating the chamber from the surrounding wellbore region. While this apparatus is effective for removing water intermittently from the wellbore, it does not provide a method for continuously removing water from the formation. It also does not readily allow for removal of coalfines from the bottom of the wellbore, requiring instead the use of a workover rig to first remove the apparatus and associated tubing, before the coalfines can be removed from the wellbore.

What is desired is an apparatus and method which is capable of removing water either continuously or intermittently from a wellbore. Preferably, the apparatus should be capable of being easily switched between the continuous and intermittent modes of operation without the need for a workover rig. Further, the apparatus should be constructed so that coalfines can be easily and efficiently removed from the chamber and the bottom of the wellbore, without the need of a workover rig.

As used herein, the following terms shall have the following meanings:

(a) "carbonaceous material" refers to the solid carbonaceous materials that are believed to be produced by the thermal and biogenic degradation of organic matter. The term carbonaceous material specifically excludes carbonates and other minerals which are believed to be produced by other types of processes;

(b) "cleats" or "cleat system" is the natural system of fractures within a solid carbonaceous subterranean formation;

(c) a "coalbed" comprises one or more coal seams in fluid communication with each other through a wellbore;

(d) "coal seams" are carbonaceous formations which typically contain between 50 and 100 percent organic material by weight;

(e) "coiled tubing" refers to a continuous length of tubing which can be stored on a reel. The coiled tubing is unreeled from the reel and run into a wellbore. Coiled tubing and its associated handling equipment typically consist of a tubing roll, storage injector heads to move the coiled tubing into or out of the wellbore, power unit and control assembly, and pressure control equipment;

(f) "gaseous desorbing fluid" includes any fluid or mixture of fluids which is capable of causing methane to desorb from a solid carbonaceous subterranean formation;

(g) "kick-off pressure" refers to the hydrostatic head exerted on the bottom of a wellbore as a result of the water present within the wellbore just prior to a gas-lift apparatus of the current invention being installed within the wellbore;

(h) "longitudinal cross-sectional area" refers to the area defined by the inner volume of a tube or body which lies within a plane that is perpendicular to the longitudinal axis of the wellbore. For a tube which has a longitudinal axis which is parallel to the wellbore's longitudinal axis, the inner volume is defined by the inside diameter of the tube;

(i) "reservoir pressure" means the pressure at the face of the productive formation when the well is shut-in. The reservoir pressure can vary throughout the formation. Also, the reservoir pressure may change over time as fluids are produced from the formation and/or gaseous desorbing fluid is injected into the formation;

(j) "seating nipple" refers to a member configured to accept a valve body. The seating nipple mates with the body of the valve. Typically, a seating nipple comprises a short piece of tubing which has an internal diameter which is slightly smaller than the internal diameter of a tubing to which it is typically coupled;

(k) "solid carbonaceous subterranean formation" refers to any substantially solid carbonaceous, methane-containing material located below the surface of the earth. It is believed that these methane-containing materials are produced by the thermal and biogenic degradation of organic matter. Solid carbonaceous subterranean formations include but are not limited to coalbeds and other carbonaceous formations such as antrium, carbonaceous, and devonian shales;

(l) "wireline" is a strong length of wire that typically is between 0.070 and 0.092 inches in diameter and is typically mounted on a powered reel at the surface of the earth near a wellbore. The wireline is used to transfer wireline retrievable tools into the wellbore. The wireline is often guided into the wellbore with a mast which aids in the alignment of the wireline within the center of the wellbore;

(m) "wireline retrievable tools" are tools which can be transferred into and out of a wellbore using a wireline. Wireline retrievable tools can be used to perform such tasks as wellbore depth measurement, fishing for lost parts and junk retrieval, and the manipulation and installation of downhole fluid flow control devices; and (n) "workover rig" refers to a rig which is used to insert and remove tubular piping sections from a wellbore. A workover rig includes a derrick and associated pipe handling gear. Workover rigs are typically used for inserting and pulling a sectional tubing string from a wellbore and for installing artificial water lift equipment.

SUMMARY OF THE INVENTION

The invention provides a simple, yet effective, method and apparatus for continuously or intermittently removing water from a wellbore which penetrates a solid carbonaceous subterranean formation.

In a first aspect of the invention, a method is disclosed for removing water from a wellbore which penetrates at least one carbonaceous seam and has perforations which allow methane and water to flow from the at least one carbonaceous seam into the wellbore, the method comprising the steps of:

a) installing a gas-lift apparatus in the wellbore, the gas-lift apparatus comprising:
   a chamber for collecting water;
   a valve receiving means coupled to the chamber; and
   a linear access means for transferring a wireline into and at least partially through the chamber;

b) operating the gas-lift apparatus in a continuous water removal mode;

c) switching the gas-lift apparatus from the continuous water removal mode to an intermittent water removal mode using a wireline retrievable tool; and d) operating the gas-lift apparatus in the intermittent water removal mode.

In a second aspect of the invention, an apparatus is disclosed for recovering water from a wellbore, having a longitudinal axis, to a wellhead located at the earth's surface, the apparatus comprising:

a chamber for collecting water, the chamber having an upper and a lower end;

a valve receiving means for receiving a valve coupled to the lower end of the chamber;

a water transport tubing for transporting water from the chamber, the water transport tubing having a lower end coupled to the upper end of the chamber;

a linear axis means for transferring a wireline into and at least partially through the chamber which is formed by an axial alignment of the lower end of the water transport tubing and the chamber about the longitudinal axis of the wellbore; and coiled tubing located externally to the water transport tubing, the coiled tubing having an upper end coupled to the wellhead and having a lower end operatively coupled to the chamber for conducting pressurized lift-gas from the wellhead to the chamber to facilitate the removal of water from the chamber.

In a third aspect of the invention, an apparatus is disclosed for recovering methane from a wellbore which penetrates at least one coal seam and for concurrently removing water from the wellbore to the surface of the earth, comprising:

casing set within the wellbore for conducting the methane to the surface of the earth;

perforations which penetrate the casing in regions of the wellbore which are adjacent to the at least one coal seam, the perforations allowing methane to travel from the at least one coal seam into the wellbore;

a chamber located within a portion of the casing, the chamber having an upper end and a lower end and having an maximum longitudinal cross-sectional area;

a seating nipple coupled to the lower end of the chamber, the seating nipple being configured for receiving a valve and having a longitudinal cross-sectional area which is smaller than the chamber's maximum longitudinal cross-sectional area;

a water transport tubing located within the casing for transporting water to the surface of the earth, the water transport tubing having a lower end coupled to the upper end of the chamber, the lower end of the water transport tubing having a longitudinal cross-sectional area which is smaller than the chamber's maximum longitudinal cross-sectional area, the lower end of the water transport tubing, the chamber, and the seating nipple being axially aligned about the longitudinal axis of the wellbore to form a linear access means for transferring a wireline into and at least partially through the chamber; and coiled tubing operatively coupled to the chamber and located within the casing and externally to the water transport tubing for conducting pressurized lift-gas from the earth's surface to the chamber to facilitate the removal of water through the water transport tubing to the earth's surface.

The invention is capable of operating in the continuous water removal mode early in the life of the wellbore when the formation's reservoir pressure is higher and water production rates are expected to be relatively high. Later in the life of the wellbore, as the water production rate decreases and the formation's reservoir pressure decreases, the apparatus can be easily converted to the intermittent water removal mode of operation using wireline retrievable tools. The use of wireline retrievable tools to switch the apparatus between the continuous water removal mode of operation and the intermittent water removal mode of operation is facilitated by the linear access means that is formed by the axial alignment of the chamber, the lower end of the water transport tubing, and preferably the valve receiving means about the longitudinal axis of the wellbore.

The ability to convert the apparatus from continuous to intermittent operation without the need for a workover rig will save both time and money. Further, the linear access means allows coalfines to be removed from the chamber and the bottom of the wellbore without the need for a workover rig.

Further, the use of coiled tubing in the apparatus greatly reduces the time and effort required to install the apparatus within the wellbore. The coiled tubing also allows for the use of a larger diameter water transport tubing, if desired.

The above advantages of the invention and other advantages that will be apparent to one of ordinary skill in the art, in view of the following description of the invention, will greatly reduce the costs associated with operating a wellbore which penetrates a solid carbonaceous subterranean formation. Additionally, since less time is required to clean out the wellbore and to switch between continuous and intermittent operations, the wellbore can be in operation a higher percentage of the time.

BRIEF DESCRIPTION OF THE DRAWINGS

FIG. 2 is a cross-sectional view (not to scale) of the gas-lift apparatus of FIG. 1 configured to operate in an intermittent water removal mode.

FIG. 3 is a partial cross-sectional view of a side-pocket mandrel utilized in one aspect of the invention.

DESCRIPTION OF THE INVENTION

Figure 1:
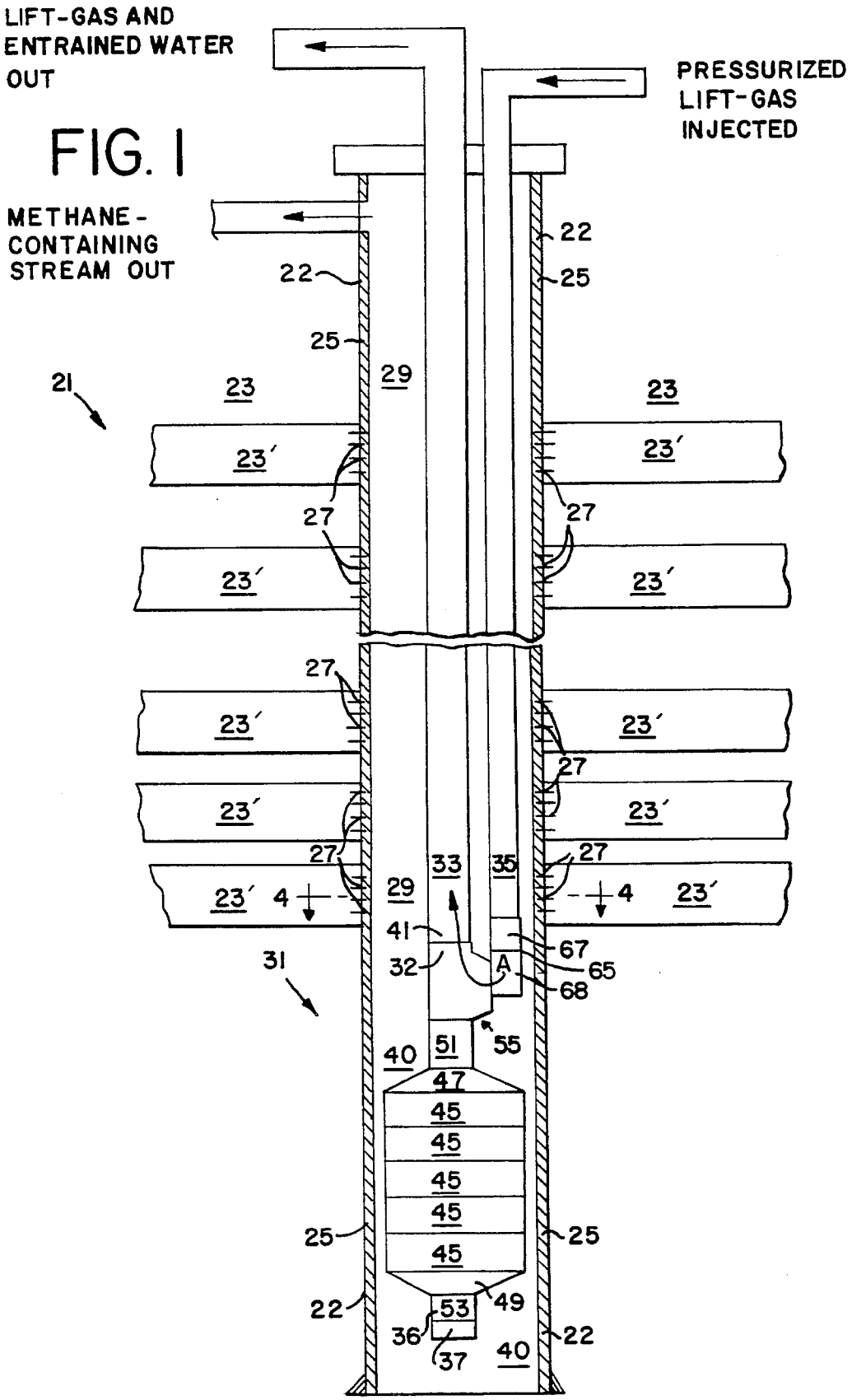
FIG. 1 is a schematic drawing of a gas-lift apparatus in accordance with the invention which is suspended within a wellbore.

While this invention is susceptible of embodiment in many different forms, there is shown in the drawings, and will herein be described in detail, specific embodiments of the invention. It should be understood, however, that the present disclosure is to be considered an exemplification of the principles of the invention and is not intended to limit the invention to the specific embodiments illustrated.

Referring to FIG. 1, a gas-lift apparatus 21 of the current invention is shown installed in a wellbore 22. Wellbore 22 penetrates a solid carbonaceous subterranean formation 23 which is comprised of several vertically separated individual carbonaceous seams 23'. Wellbore 22 is typically lined with casing 25 which has perforations 27 in the regions of the wellbore adjacent to carbonaceous seams 23'. Perforations 27 are made in a manner known to one of ordinary skill in the art and provide fluid communication between an interior wellbore volume 29 and carbonaceous seams 23'. Alternatively, wellbore intervals which are adjacent to carbonaceous seams 23' may be completed using open-hole techniques which may or may not utilize perforated liners placed within the open-hole wellbore interval.

Gas-lift apparatus 21 has a chamber 31 for collecting water, which is preferably coupled at its upper end 32 to water transport tubing 33. Chamber 31 is also coupled to coiled tubing 35. Chamber 31 is coupled at its lower end 36 to a seating nipple 37 that is configured for receiving a valve 39 (see FIG. 2). As shown in FIG. 1, Chamber 31 is preferably at least partially located within a sump 40, which is an extension of wellbore 22 located below wellbore 22's lowermost perforation 27. The use of a sump 40 minimizes the chance of standing water in wellbore 22 applying backpressure to carbonaceous seams 23' of formation 23.

Coiled tubing 35 is located within wellbore 22, but externally to water transport tubing 33. Coiled tubing 35 conducts a pressurized lift-gas from a wellhead 73 (see FIG. 5) to chamber 31. As discussed earlier, the use of coiled tubing 35 greatly reduces the time and effort required to install the apparatus 21 within wellbore 22. It also makes it easier to remove apparatus 21 from wellbore 22. Further, the use of coiled tubing 35 allows a larger diameter water transport tubing 33 to be utilized than would be possible if a sectional tubing string was used to conduct pressurized lift-gas to chamber 31.

Figure 4:
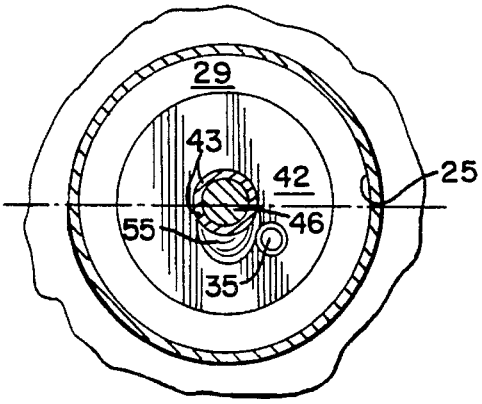
FIG. 4 is a cross-sectional view of the gas-lift apparatus taken along line 4—4 of FIG. 1.

Referring to FIGS. 1 and 4, an inner diameter of the chamber 31 defines a longitudinal cross-sectional area 42 (shown at its widest point). An inner diameter of a lower end 41 of water transport tubing 33 defines a longitudinal cross-sectional area 43. Chamber 31 and the lower end 41 of water transport tubing 33 are axially aligned with each other about the longitudinal axis of wellbore 22, so that at least a portion of their longitudinal cross-sectional areas, 42 and 43, respectively, intersect when projected onto a plane which is perpendicular to the longitudinal axis of wellbore 22. This alignment forms a linear access means for transferring a wireline into and at least partially through chamber 31. The linear access means will facilitate switching gas-lift apparatus 21 from a continuous water removal mode to an intermittent water removal mode using wireline retrievable tools. This ability to use wireline retrievable tools will make it much easier and more efficient to switch between the continuous water removal mode and the intermittent water removal mode.

In one aspect of the invention, valve 39 (see FIG. 2) is initially installed in gas-lift apparatus 21, but is gagged in an open position when apparatus 21 is placed within wellbore 22. Since valve 39 is gagged in the open position, it will allow water to flow into chamber 31 while pressurized lift-gas is injected into chamber 31. When it is desired to switch apparatus 21 from the continuous water removal mode to the intermittent water removal mode, a wireline retrievable tool is transferred into chamber 31 to ungag valve 39 so that it closes when pressurized lift-gas is injected into chamber 31. Preferably, seating nipple 37 is axially aligned with lower end 41 of water transport tubing 33 and with chamber 31 about the longitudinal axis of wellbore 22 to form a linear access means which extends through seating nipple 37. This will make it relatively easier to ungag valve 39. Also, if valve 39 is removed from apparatus 21 using wireline retrievable tools, a wireline can then be passed through the linear access means to the bottom of wellbore 22.

In another aspect of the invention, gas-lift apparatus 21 is initially installed within wellbore 22 without valve 39. In this aspect, a longitudinal cross-sectional area 46, defined by the inner diameter of seating nipple 37, is preferably smaller than longitudinal cross-sectional area 43. In this aspect, seating nipple 37 is axially aligned with lower end 41 of water transport tubing 33 and with chamber 31 about the longitudinal axis of wellbore 22 to form the linear access means which in this aspect extends through the seating nipple 37. The linear access means extending through the seating nipple 37 facilitates the installation of valve 39 at a later time using wireline retrievable tools. Additionally, in this aspect of the invention, coalfines can be removed from the region of wellbore 22 located beneath chamber 31 during the continuous water removal mode by transferring wireline retrievable tools through the linear access means and into the bottom of wellbore 22.

Chamber 31 forms a collection tank for collecting water from wellbore 22. The chamber 31's longitudinal cross-sectional area 42, at its widest point, is larger than the longitudinal cross-sectional area 43 of the lower end 41 of water transport tubing 33 and preferably larger than the longitudinal cross-sectional area 46 of seating nipple 37. This allows chamber 31 to collect more water than a tubing string which has the same cross-sectional area as the lower end 41 of water transport tubing 33. For ease of construction and in order to simplify the installation of chamber 31 within wellbore 22, chamber 31 is preferably comprised of several segments.

Referring to FIGS. 1 and 4, an embodiment of the invention is shown in which chamber 31 is comprised of cylindrical segments 45, changeover pieces 47 and 49, cylindrical tubing subs 51 and 53, and a mandrel assembly 55. The plurality of cylindrical segments 45 define the outer expanse of chamber 31's inner diameter. Cylindrical segments 45 and changeover pieces 47 and 49 are preferably constructed of fiberglass. Fiberglass is preferably used because coalfines do not easily adhere to it. Also, if chamber 31 becomes stuck within wellbore 22, the fiberglass can be easily cut or broken so that mandrel assembly 55, water transport tubing 33, and coiled tubing 35 can be removed from wellbore 22.

Each cylindrical segment 45 is approximately thirty feet (30') in length. The outer diameter of cylindrical segments 45 preferably is one to two inches smaller than the inner diameter of casing 25 which circumferentially surrounds segments 45. For a typical wellbore, casing 25 will have an inner diameter of between four and eight inches. Cylindrical segments 45 can be coupled together using means known to one of ordinary skill in the art. For example, they may be coupled together using female mating collars or, alternatively, segments 45 can be threaded on their ends so that they can be directly threaded and connected together.

Changeover pieces 47 and 49 connect cylindrical segments 45 with cylindrical tubing subs 51 and 53. Cylindrical tubing subs 51 and 53 preferably have approximately the same inner diameter as the lower end 41 of water transport tubing 33, which preferably has an inner diameter of between two and four inches. Cylindrical tubing subs 51 and 53 are typically constructed of some type of metal, preferably steel. The lower cylindrical tubing sub 53 is preferably between one and two feet in length. The lower cylindrical tubing sub 53 provides a means for coupling seating nipple 37 to the lower changeover piece 49 and provides an internal buffer volume in which coalfines can collect before entering the region of chamber 31 defined by cylindrical segments 45. The upper tubing sub 51 couples the upper changeover piece 47 with mandrel assembly 55.

Mandrel assembly 55 is coupled to water transport tubing 33 and coiled tubing 35. Mandrel assembly 55 is preferably constructed of metals which are suitably used in wellbores which penetrate solid carbonaceous subterranean formations. The inner diameter of a central passageway 57 (see FIG. 3) of mandrel assembly 55, the inner diameter of tubing subs 51 and 53 (if used), and the inner diameter of changeover pieces 47 and 49 (if used) are preferably at least as large as the inner diameter of the lower end 41 of water transport tubing 33. This will further facilitate the placement of a valve 39 (see FIG. 2) within seating nipple 37 using a wireline retrievable tool. It will also ensure that wireline retrievable tools, which are able to be passed through the lower end 41 of water transport tubing 33, are also able to be passed through chamber 31. Thus, the expense and complication of having to use a workover rig will be avoided. More preferably, the inner diameter of central passageway 57, the inner diameter of tubing subs 51 and 53 (if used), the inner diameter of changeover pieces 47 and 49, the inner diameter of the lower end 41 of water transport tubing 33, the inner diameter of cylindrical segments 45, and the inner diameter of seating nipple 37 are axially aligned so that they are approximately concentric with each other. If any of the components of apparatus 21 are not cylindrically shaped, then the inner diameter is defined by the largest circle which can bee formed within the longitudinal cross-sectional area of the component.

Referring to FIG. 2, a gas-lift apparatus 21 in accordance with the invention is shown configured for intermittently removing water and other fluids from wellbore 22. The gas-lift apparatus 21, as shown in FIG. 2, is the same as a gas-lift apparatus 21 which is configured for continuously removing water from wellbore 22, except that a tubing packer seal 59 and a siphon string 61 have been installed within gas-lift apparatus 21. Tubing packer seal 59 carries and seals siphon string 61 within the gas-lift apparatus 21. Preferably, tubing packer seal 59 is set within water transport tubing 33 with siphon string 61 extending to a point within lower tubing sub 53, as shown. Additionally, if valve 39 was originally installed within apparatus 21 when it was initially placed within wellbore 22, then, as discussed earlier, valve 39 should be ungagged to configure gas-lift apparatus 21 for the intermittent water removal mode of operation. If valve 39 was not originally installed within apparatus 21 when it was initially placed within wellbore 22, then, as discussed earlier, valve 39 should be installed within seating nipple 37 to configure the gas-lift apparatus 21 for the intermittent water removal mode of operation.

Valve 39 is preferably a standing valve, which is known to one of ordinary skill in the art. When apparatus 21 is configured for the intermittent water removal mode of operation, valve 39 is normally open for permitting fluid in wellbore 22 to flow into chamber 31, but closes when pressurized lift-gas is injected into chamber 31. Siphon string 61 preferably has an inner diameter approximately one to three inches smaller than the inner diameter of the lower end 41 of water transport tubing 33. Because of the sizing of the components which make up apparatus 21 and their geometric arrangement, valve 39, tubing packer seal 59, and siphon string 61 can all be installed using wireline retrievable tools.

Referring to FIG. 3, a mandrel assembly 55, which is preferably utilized in the invention, is shown coupled to coiled tubing 35. Coiled tubing 35 preferably has an inner diameter of from three quarters to one and one-half inches. Mandrel assembly 55, shown in FIG. 3, is of the side-pocket type. As discussed earlier, mandrel assembly 55 has a central passageway 57 which penetrates and passes through the body of mandrel assembly 55. As discussed earlier, the internal diameter of passageway 57 is preferably at least as large as the internal diameter of the lower end 41 of water transport tubing 33. A valve pocket 63 installed in mandrel assembly 55 contains a gas-lift valve 64 which controls the flow of fluids between coiled tubing 35 and central passageway 57. Valve 64 preferably is a pressure actuated valve which has a pressure setpoint which is set low enough so that valve 64 opens when pressurized lift-gas is injected into coiled tubing 35, but high enough to lock in a pressure within coiled tubing 35 when pressurized lift-gas is not being injected into coiled tubing 35. Locking in a pressure will minimize the amount of pressurized lift-gas which must be used to repressurize coiled tubing 35 during each injection cycle. Valve 64 is preferably set initially to open at a pressure of from 50 to 80% of the kick-off pressure for wellbore 22, more preferably, from 65 to 75% of the kick-off pressure for wellbore 22. Gas-lift valve 64 preferably is changeable through water transport tubing 33 using wireline retrievable tools.

Mandrel assembly 55 preferably has a coiled tubing receiver 65, which has a coiled tubing connector 67 and a coiled tubing sub 68. Coiled tubing connector 67 couples coiled tubing 35 to coiled tubing receiver 65. Coiled tubing sub 68 couples coiled tubing receiver 65 to the main body of mandrel assembly 55. Coiled tubing sub 68 is held in position by side string lug 69 and by external deflector lugs 71.

Figure 5:
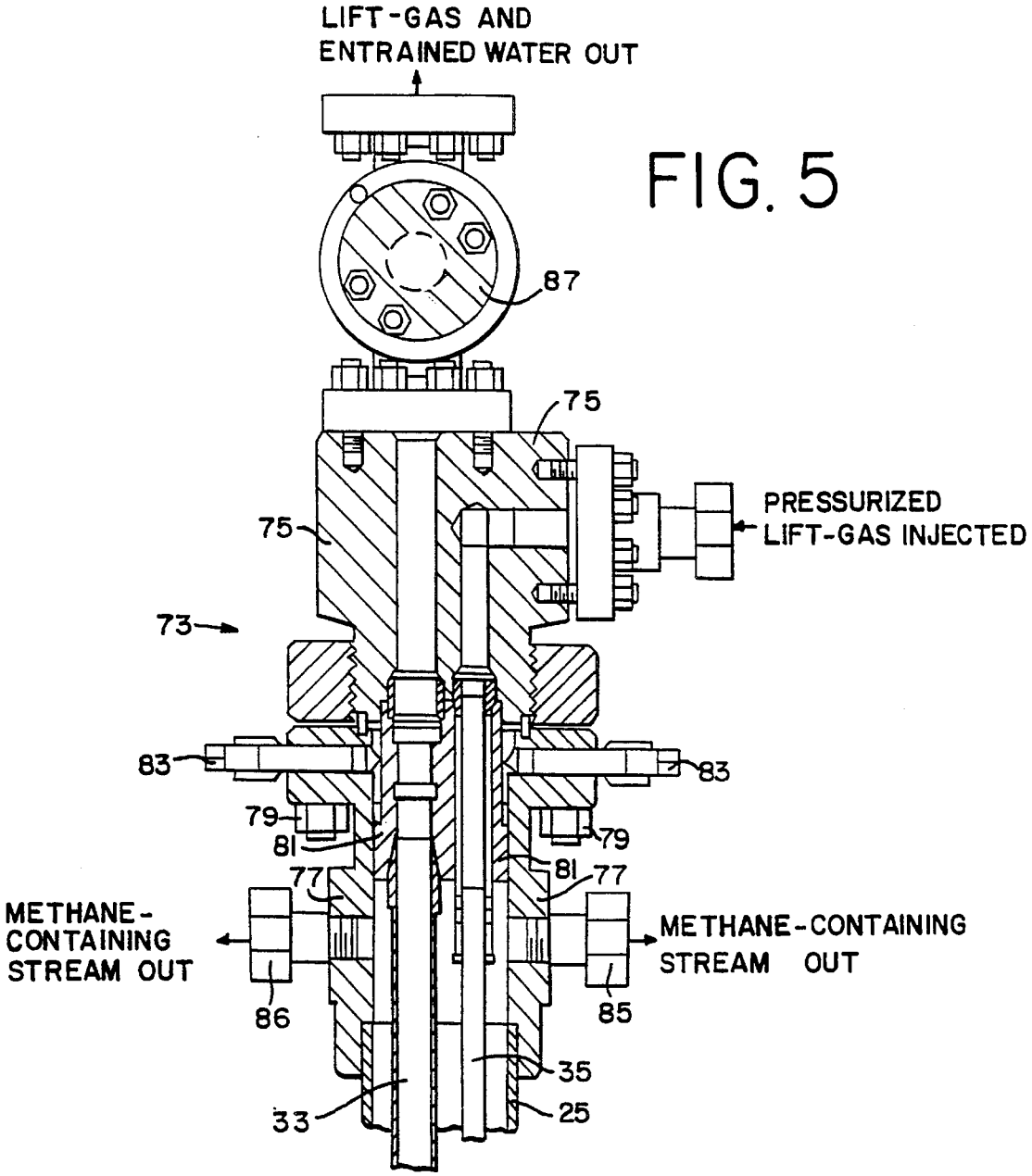
FIG. 5 is an elevational view of a wellhead which may be used with the invention.

Referring now to FIG. 5, a wellhead 73 is shown which holds various tubing strings in place at the surface of the earth. Wellhead 73 is similar to conventional dual tubing string wellheads known to one of ordinary skill in the art except that it has been adapted to carry coiled tubing 35. Wellhead 73 is comprised of an upper body 75 and a lower body 77, which are coupled together by fasteners 79. A tubing hanger 81 carries both water transport tubing 33 and coiled tubing 35. Tubing hanger 81 is secured within wellhead 73 by tubing head screws 83, which slide into indentations machined into tubing hanger 81. Lower body 77 is screwed onto the top of casing 25.

A methane-containing stream flows up interior wellbore volume 29 (see FIG. 1 ), which surrounds water transport tubing 33 and coiled tubing 35, and into lower body 77 before exiting wellhead 73 through ports 85 and 86. After leaving wellhead 73, the methane-containing stream flows to a suitable separator which will separate the gases from any liquids. The preferred separator to use is a gas-liquid separator which is located beneath the ground. The separated gas flows from the separator to a storage system or directly to a pipeline gathering system.

During gas-lift operations, water and other fluids travel up the water transport tubing 33 and into wellhead 73. Isolation valve 87 is normally open to allow the water and other fluids to pass through the wellhead and into a suitable gas-liquid separator.

During gas-lift operations, pressurized lift-gas is directed to wellhead 73 through a flow control device (not shown in the FIGS.). Because gas-lift apparatus 21 is capable of operating in both continuous and intermittent water removal modes of operation, it is preferable that the flow control device be a motor operated valve or some other type of flow control device which can be set to open and close automatically under preset conditions. Once within wellhead 73, the pressurized lift-gas is directed into coiled tubing 35, which will conduct it to chamber 31.

Operation

Referring to FIGS. 1 through 5, gas-lift apparatus 21 of the present invention may be operated in the following manner. Gas-lift apparatus 21 is lowered into wellbore 22 to the desired location in a manner known to one of ordinary skill in the art. Gas-lift apparatus preferably is initially configured for the continuous water removal mode of operation. When gas-lift apparatus 21 is operated in the continuous water removal mode, lift-gas is not required to be continuously injected into chamber 31 through coiled tubing 35. However, when apparatus 21 is configured for the continuous water removal mode of operation, water can be effectively removed from wellbore 22 by continuously injecting pressurized lift-gas into chamber 31 through coiled tubing 35. During the continuous water removal mode, rapid dewatering of carbonaceous seams 23' surrounding wellbore 22 occurs. When gas-lift apparatus 21 is initially installed in wellbore 22, chamber 31 should have a large enough collection tank volume so that it can later efficiently operate in the intermittent water removal mode of operation. If cylindrical segments 45 are utilized, the size of the collection tank can be increased by adding additional cylindrical segments 45 before apparatus 21 is installed in wellbore 22.

The pressurized lift-gas can be provided by any convenient source. For example, the lift-gas may be provided from a natural gas gathering system located near wellbore 22, or from a separate gas compressor. If primary pressure depletion methane recovery techniques are being utilized on a production field, it is preferable to utilize natural gas from the gathering system as a lift-gas. If enhanced methane recovery techniques are being utilized on a production field, a gaseous desorbing fluid being utilized to enhance the recovery of methane from the field can be used for the lift-gas.

Now referring specifically to FIGS. 1 and 3, when the apparatus 21 is configured for the continuous water removal mode, pressurized lift-gas preferably at a pressure of from 10 to 50% above the gas-lift valve 64's initial pressure setpoint will be conducted through coiled tubing 35 to mandrel assembly 55. Injecting the pressurized lift-gas at a pressure of between 10 to 50% above the gas-lift valve 64's setpoint should ensure that the valve fully opens. Within mandrel assembly 55, the lift-gas will be routed into central passageway 57. Water contained in passageway 57 will be entrained by the lift-gas and carried with the lift-gas to wellhead 73. The flow path of the lift-gas during the continuous water removal mode of operation is depicted by arrow A on FIG. 1. At the surface, the lift-gas and entrained water will be routed through wellhead 73 to a gas-liquid separator. Preferably, chamber 31 should be suspended within wellbore 22 so that the top of chamber 31 is below the lowermost carbonaceous seam 23' from which methane is being recovered. If wellbore 22 is lined with casing 25, chamber 31 should preferably be suspended so that coiled tubing sub 68 is located at a point within wellbore 22 which is vertically beneath the lowermost perforation 27. This will minimize the fluid level within wellbore 22 and thereby facilitate the recovery of methane from wellbore 22.

With the invention, a methane-containing stream can be recovered from formation 23 while water is concurrently being recovered from wellbore 22. The methane-containing stream flows into wellbore 22 through perforations 27 and then flows up interior wellbore volume 29, which surrounds coiled tubing 35 and water transport tubing 33. The methane-containing stream flows through wellhead 73, which directs it through ports 85 and 86 to a gas-liquid separator. Preferably, the methane-containing stream is routed to the same gas-liquid separator to which the lift-gas with entrained water is routed.

Once the water production rate has been reduced to a desired level, gas-lift apparatus 21 should be converted to the intermittent water removal mode of operation. Water and other liquids can be more efficiently removed from wellbore 22 using the intermittent water removal mode (i.e., more water removed for a given quantity of lift-gas injected into the chamber 31). Also, during the intermittent water removal mode, there is less chance of the pressurized lift-gas applying a backpressure to the solid carbonaceous subterranean formation 23.

Turning now to FIG. 2, gas-lift apparatus 21 can be converted to the intermittent water removal mode of operation by installing tubing packer seal 59, siphon string 61, and by either ungagging valve 39 or installing valve 39. As discussed earlier, tubing packer seal 59, siphon string 61, and valve 39 can be installed within apparatus 21 using wireline retrievable tools in a manner known to one of ordinary skill in the art. Once gas-lift apparatus 21 has been converted to the intermittent water removal mode of operation, water removal and the recovery of methane can commence again from wellbore 22.

When apparatus 21 is operating in the intermittent water removal mode, the pressurized lift-gas is conducted down coiled tubing 35 and into chamber 31, as depicted by arrow B. Within chamber 31, the pressurized lift-gas travels around siphon string 61 as depicted by arrow C. The pressurized lift-gas pushes against the water in chamber 31 and causes valve 39 to close, thereby preventing water from flowing out of chamber 31 through valve 39. The pressure produced within chamber 31 by the pressurized lift-gas also pushes water up siphon string 61 and out of chamber 31, as depicted by arrows D and E.

During the intermittent water removal mode of operation, the duration of each lift-gas injection cycle and the time between individual injection cycles can be empirically determined in the field. It is desirable that each injection cycle be long enough so that a majority of liquids within chamber 31 at the beginning of each cycle is transported to the surface, but not so long that a large quantity of lift-gas is wasted. The time between cycles should be adjusted so that the level in wellbore 22 stays below a desired level. Preferably, the time between injection cycles should be short enough to ensure that the liquid level in chamber 31 does not rise to the bottom of tubing packer seal 59. Preferably, pressurized lift-gas is injected for between one to twenty minutes during each injection cycle. It is preferred that chamber 31 is sized so that no more than four lift-gas injection cycles per hour be required. Preferably, timing circuitry is utilized to control the duration of each injection cycle and to control the time between each cycle. Alternatively, a differential pressure transmitter can be used to monitor the liquid level in chamber 31. The level signal developed by the differential pressure transmitter is routed to control circuitry. The control circuitry, which is known to one of ordinary skill in the art, should be set up to cause pressurized lift-gas to be injected into chamber 31 whenever the transmitter indicates that a preset high liquid level has been reached and to cause injection to cease when the transmitter indicates that the liquid level has been pumped down to a preset low liquid level.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made and materials may be substituted for those described in the description. For example, a one-piece chamber could be used which is not comprised of several different segments. Also, a chamber which does not have a mandrel assembly, changeover pieces, or cylindrical tubing subs could be used for the invention.

Thus, it will be appreciated that various modifications, alternatives, variations, etc., may be made without departing from the spirit and scope of the invention as defined in the appended claims. It is of course, intended that all such modifications are covered by the appended claims.

We claim:

1. A method for removing water from a wellbore which penetrates at least one carbonaceous seam and has perforations which allow methane and water to flow from the at least one carbonaceous seam into the wellbore, the method comprising the steps of:

a) installing a gas-lift apparatus in the wellbore, the gas-lift apparatus comprising:
   a chamber for collecting water;
   a valve receiving means coupled to the chamber; and
   a linear access means for transferring a wireline into and at least partially through the chamber;

b) operating the gas-lift apparatus in a continuous water removal mode;

c) switching the gas-lift apparatus from the continuous water removal mode to an intermittent water removal mode using a wireline retrievable tool; and d) operating the gas-lift apparatus in the intermittent water removal mode.

2. The method of claim 1, further comprising:

d) recovering methane from the at least one carbonaceous seam concurrently with steps b) and d).

3. The method of claim 1, wherein the gas-lift apparatus further comprises a valve coupled to the valve receiving means, the valve initially being aligned to allow water to flow from the wellbore into the chamber while a pressurized lift-gas is injected into the chamber during step b) and wherein switching the gas-lift apparatus from the continuous water removal mode to the intermittent water removal mode comprises realigning the valve to minimize the movement of water into the chamber when pressurized lift-gas is injected into the chamber.

4. The method of claim 3, wherein the valve is locked open during step b) to allow water to flow into the chamber while pressurized lift-gas is injected into the chamber and wherein the valve is unlocked, during the realignment step, so that it closes when pressurized lift-gas is injected into the chamber.

5. The method of claim 1, wherein switching the gas-lift apparatus from the continuous water removal mode to the intermittent water removal mode comprises installing a valve within the valve receiving means, the valve being configured to close when a pressurized lift-gas is injected into the chamber to minimize leakage of water from the chamber to the wellbore.

6. The method of claim 5, wherein operating step d) comprises cyclically injecting pressurized lift-gas into the chamber in individual cycles.

7. The method of claim 6, wherein the chamber is sized so that pressurized lift-gas is injected for between about 1 and 20 minutes during the individual cycles.

8. The method of claim 6, wherein the chamber is sized so that there are no more than four individual cycles per hour.

9. The method of claim 5, wherein switching the gas-lift apparatus from the continuous water removal mode to the intermittent water removal mode further comprises installing a siphon string within the apparatus which is located coaxially within the chamber.

10. The method of claim 1, wherein the chamber is at least partially located within a sump which extends below a lowermost perforation in the wellbore.

11. The method of claim 1, wherein the gas-lift apparatus further comprises a gas-lift valve which controls the flow of a pressurized lift-gas into the chamber, the gas-lift valve being pressure actuated and having an initial pressure setpoint of from about 50 to 80% of a kick-off pressure for the wellbore and wherein operating step d) includes injecting the pressurized lift-gas into the chamber at a pressure of from about 10 to 50% greater than the gas-lift valve's initial pressure setpoint.

12. The method of claim 11, wherein the pressurized lift-gas comprises methane.

13. The method of claim 1, wherein the at least one carbonaceous seam comprises a coalbed.

14. An apparatus for recovering water from a wellbore, having a longitudinal axis, to a wellhead located at the earth's surface, comprising:

a chamber for collecting water, the chamber having an upper and a lower end;

a valve receiving means for receiving a valve coupled to the lower end of the chamber;

a water transport tubing for transporting water from the chamber, the water transport tubing having a lower end coupled to the upper end of the chamber;

a linear axis means for transferring a wireline into and at least partially through the chamber which is formed by an axial alignment of the lower end of the water transport tubing and the chamber about the longitudinal axis of the wellbore; and coiled tubing located externally to the water transport tubing, the coiled tubing having an upper end coupled to the wellhead and having a lower end operatively coupled to the chamber for conducting pressurized lift-gas from the wellhead to the chamber to facilitate the removal of water from the chamber.

15. The apparatus of claim 14, wherein the valve receiving means comprises a seating nipple which is axially aligned with the lower end of the water transport tubing and the chamber about the longitudinal axis of the wellbore to form a portion of the linear axis means.

16. The apparatus of claim 15, being configured for intermittently removing water from the wellbore, the apparatus further comprising:

a valve set within the seating nipple which seals when pressurized lift-gas is conducted into the chamber to minimize the movement of water from the chamber to the wellbore; and a siphon string, located approximately coaxially within the linear access means, which facilitates the transferral of at least a portion of the water located within the chamber from the chamber into the water transport tubing when pressurized lift-gas is conducted into the chamber.

17. The apparatus of claim 16, wherein the siphon string is carried by a tubing packer seal mounted within the water transport tubing.

18. The apparatus of claim 17, wherein the chamber comprises a mandrel assembly located near the upper end of the chamber, the mandrel assembly having a first passageway to conduct pressurized lift-gas from the coiled tubing into the chamber and having a central passageway which surrounds the siphon string and which is axially aligned about the longitudinal axis of the wellbore to form a portion of the linear access means.

19. The apparatus of claim 18, wherein the mandrel assembly further comprises a gas-lift valve having an initial pressure setpoint of from about 50 to 80% of a kick-off pressure for the wellbore.

20. The apparatus of claim 15, wherein a longitudinal cross-sectional area of the seating nipple is smaller that a longitudinal cross-sectional area of the lower end of the water transport tubing, and the longitudinal cross-sectional area of the lower end of the water transport tubing is smaller than a maximum longitudinal cross-sectional area of the chamber.

21. An apparatus for recovering methane from a wellbore which penetrates at least one coal seam and for concurrently removing water from the wellbore to the surface of the earth, comprising:

casing set within the wellbore for conducting the methane to the surface of the earth;

perforations which penetrate the casing in regions of the wellbore which are adjacent to the at least one coal seam, the perforations allowing methane to travel from the at least one coal seam into the wellbore;

a chamber located within a portion of the casing, the chamber having an upper end and a lower end and having a maximum longitudinal cross-sectional area;

a seating nipple coupled to the lower end of the chamber, the seating nipple being configured for receiving a valve and having a longitudinal cross-sectional area which is smaller than the chamber's maximum longitudinal cross-sectional area;

a water transport tubing located within the casing for transporting water to the surface of the earth, the water transport tubing having a lower end coupled to the upper end of the chamber, the lower end of the water transport tubing having a longitudinal cross-sectional area which is smaller than the chamber's maximum longitudinal cross-sectional area, the lower end of the water transport tubing, the chamber, and the seating nipple being axially aligned about the longitudinal axis of the wellbore to form a linear access means for transferring a wireline into and at least partially through the chamber; and coiled tubing operatively coupled to the chamber and located within the casing and externally to the water transport tubing for conducting pressurized lift-gas from the earth's surface to the chamber to facilitate the removal of water through the water transport tubing to the earth's surface.

22. The apparatus of claim 21, wherein the chamber has an outer diameter between about 1 and 2 inches smaller than an inner diameter of the casing which surrounds the chamber.

23. The apparatus of claim 21, further comprising a sump located below a lowermost perforation.

24. The apparatus of claim 21, wherein the chamber comprises a plurality of cylindrical segments.

25. The apparatus of claim 24, wherein the chamber further comprises a mandrel assembly for directing pressurized lift-gas from the coiled tubing into the chamber.

26. The apparatus of claim 25, wherein the mandrel assembly comprises:

a central passageway having a longitudinal cross-sectional area which is axially aligned about the longitudinal axis of the wellbore to form at least a portion of the linear access means.

27. The apparatus of claim 25, wherein the mandrel assembly comprises a gas-lift valve that is pressure actuated and is set to open at a pressure of from about 50 to 80% of a kick-off pressure for the wellbore.

* * * * *